United States Patent [19]

Schleffendorf

[11] Patent Number: 4,648,594

[45] Date of Patent: Mar. 10, 1987

[54] BODY TRAINING DEVICE

[76] Inventor: John J. Schleffendorf, 2312 Crescent Ave., Waukegan, Ill. 60085

[21] Appl. No.: 690,991

[22] Filed: Jan. 14, 1985

[51] Int. Cl.[4] ..... A63B 21/06

[52] U.S. Cl. ..... 272/118; 272/117; 272/136

[58] Field of Search ..... 272/116, 117, 118, 128, 272/129, 130, DIG. 4, 131, 132, 134, 135, 136

[56] References Cited

U.S. PATENT DOCUMENTS

| | | | |
|---|---|---|---|
| 3,826,490 | 7/1974 | Mossman | 272/134 |
| 4,154,441 | 5/1979 | Gajda . | |
| 4,199,139 | 4/1980 | Mahnke et al. | 272/118 |
| 4,296,924 | 10/1981 | Anzaldua et al. . | |
| 4,344,618 | 8/1982 | Dudley | 272/117 |
| 4,515,363 | 5/1985 | Schleffendorf . | |
| 4,546,971 | 10/1985 | Raasoch | 272/118 |

*Primary Examiner*—Richard J. Apley
*Assistant Examiner*—John L. Welsh
*Attorney, Agent, or Firm*—Hill, Van Santen, Steadman & Simpson

[57] ABSTRACT

A body training device is provided which allows for user alterable resistance curves as well as a low inertia exercise machine. Two resistance devices are utilized, the movement of the first device causing a varying movement of the second device and the second device dampening movement of the first device. Different resistance curves can be obtained either by changing the initial resistance of the second device or by changing the degree of interconnection between the first and second resistance devices.

9 Claims, 13 Drawing Figures

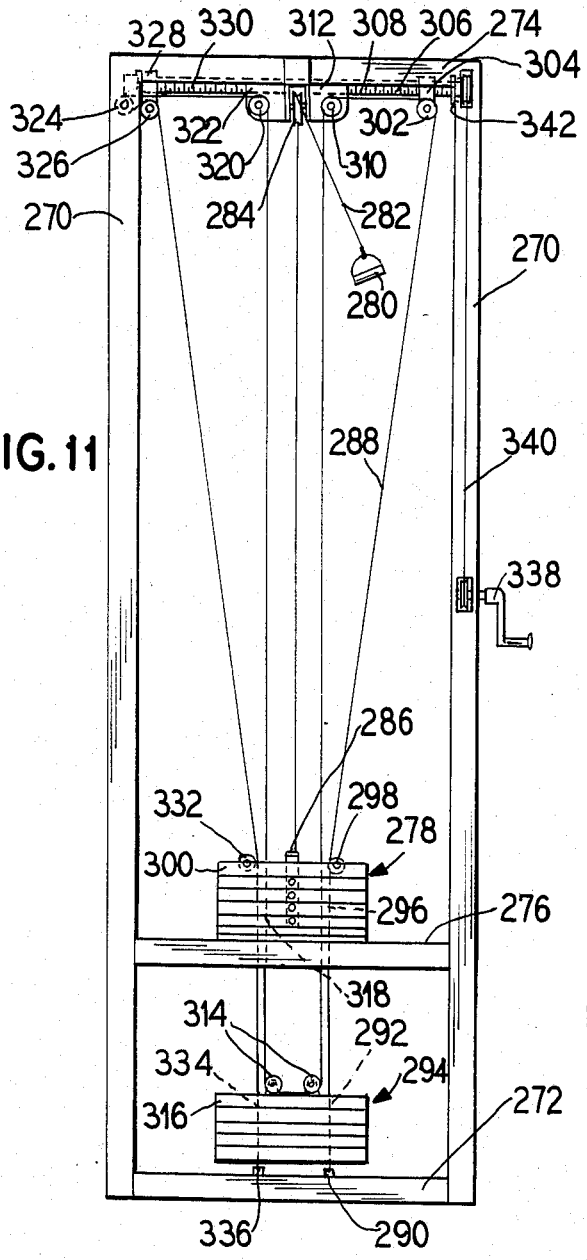
FIG. 11
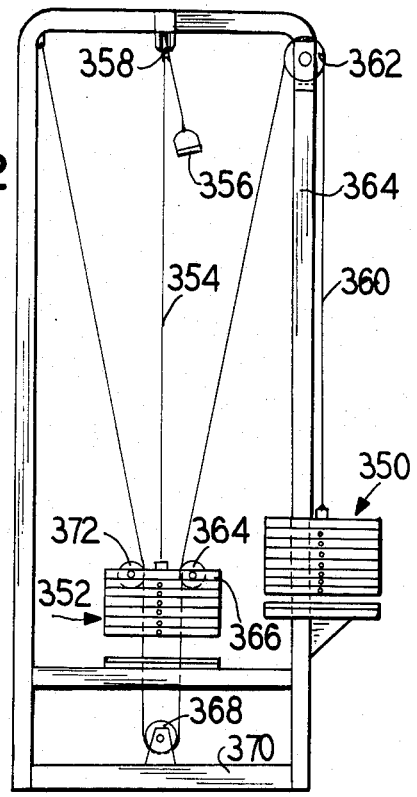
FIG. 12
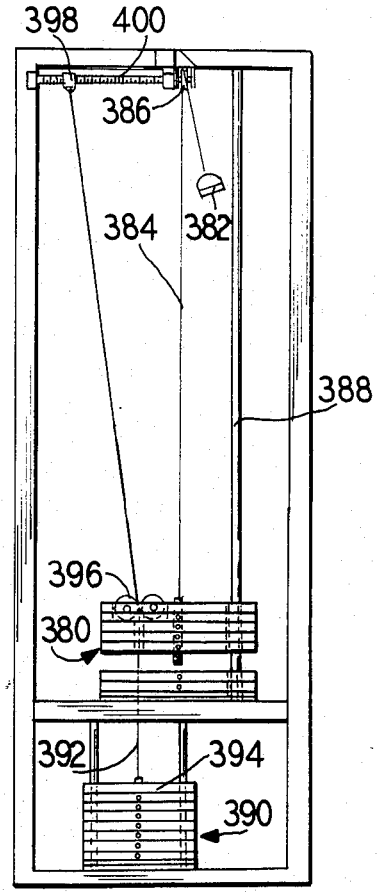
FIG. 13
FIG. 8
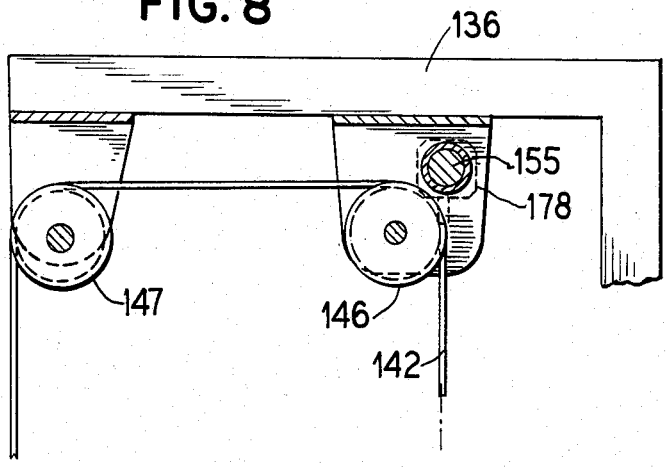

BODY TRAINING DEVICE

BACKGROUND OF THE INVENTION

1. Field of the Invention

The present invention relates to physical exercise apparatus for use in developing human muscles.

2. Description of the Prior Art

The human body has a substantial number of muscle groups and in the past various types of mechanical exercise equipment have been used to increase both muscular strength and size. However, prior exercise devices have either been relatively complex or limited in versatility and efficiency in terms of the number of muscle groups that individual apparatus could adequately develop.

Physiological studies have shown that in most cases power output or strength exerted by the human limbs or trunk actually varies in intensity throughout the normal range of motion of these body parts, due to the unique interaction of muscular strength curves and skeletal leverage.

Therefore, throughout the range of an exercise movement, resistance should, in most cases, match the power output of the contracting muscle or muscles.

Designers of prior exercise equipment have failed to recognize this principle and have provided resistance curves, inadequate in terms of generating maximum contraction of muscle fiber throughout the entire range of an exercise movement.

Currently available exercise equipment which provides changing resistance curves throughout a range of movement generally employ cams or levers or complex combinations of such components, but which generally cannot be altered by the user. Additionally, the geometry of the cams or gears is such that each set of such components is designed for the exercise of a specific muscle group and therefore separate machines must be provided for the exercise of each individual muscle group. The user of such equipment may be able to alter the weight supplied or resistance however this would merely provide a parallel shift in the resistance curve. Generally, there is not provided in the existing exercise equipment a means for altering the resistance curves to accomodate different muscle groups, and thus permit a number of muscle groups to be adequately trained on a single exercise apparatus.

SUMMARY OF THE INVENTION

The present invention provides an exercise device in which the resistance curves can be altered by the user as well as the total resistance provided by the machine. In view of such a provision, a single exercise machine can be utilized to develop various different muscle groups. This significantly reduces the cost associated with obtaining a full line of exercise equipment to exercise all of the muscle groups.

Another feature of the present invention is that the device can be characterized as low inertia which means that an increase in the speed at which each exercise is performed does not cause significant changes in the resistance curve or any harmful effects. For example, in a high inertia device, such as a barbell with dead weights, if the bar is lifted rapidly, the momentum and inertia of the moving bar will tend to keep it moving in the same direction, thus lowering the force necessary to keep the bar moving in the same direction and limiting the effective speed at which a trainee may perform exercise movements. Further, at the end of the length of travel, for instance at the full extension of the user's limb, the bar would continue moving a condition which could be conducive to the development of joint injuries.

The present device, being a low inertia device, does not have these drawbacks in that an increase in the speed of movement does not result in as great an increase in the inertia of the system thereby preserving the established resistance curve. Further, there is no tendency for the grip handle to continue to move at the end of a travel movement.

Many other advantages and features of the present invention will become manifest to those versed in the art upon making reference to the detailed description and the accompanying sheets of drawing in which preferred structural embodiments incorporating the principles of the present invention are shown by way of illustrative examples.

BRIEF DESCRIPTION OF THE DRAWINGS

FIG. 8 is a side sectional view taken generally along the line VIII—VIII of FIG. 7.

FIG. 11 is a schematic front elevational view of an alternate embodiment of the present invention.

FIG. 12 is an alternate embodiment of the present invention.

FIG. 13 is an alternate embodiment of the present invention.

DESCRIPTION OF THE PREFERRED EMBODIMENTS

Figure 1:
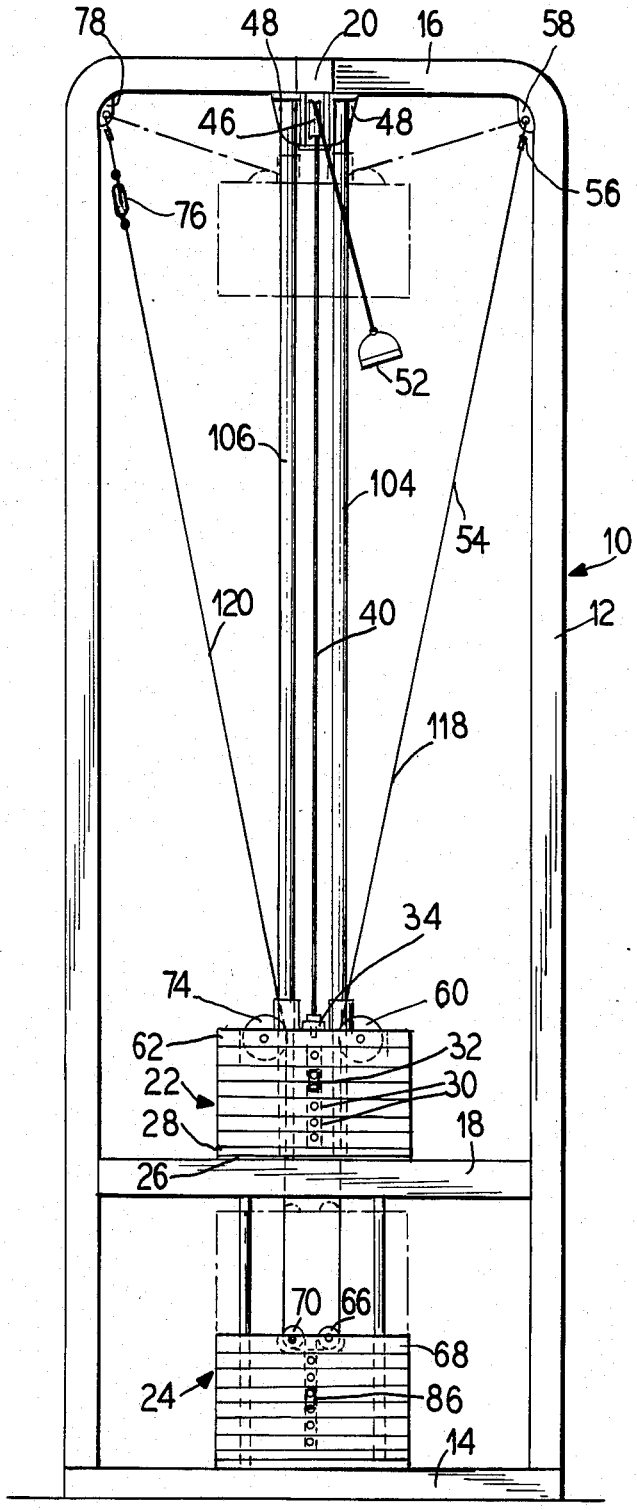
FIG. 1 is a front elevational view of a body training device embodying the principles of the present invention.
Figure 2:
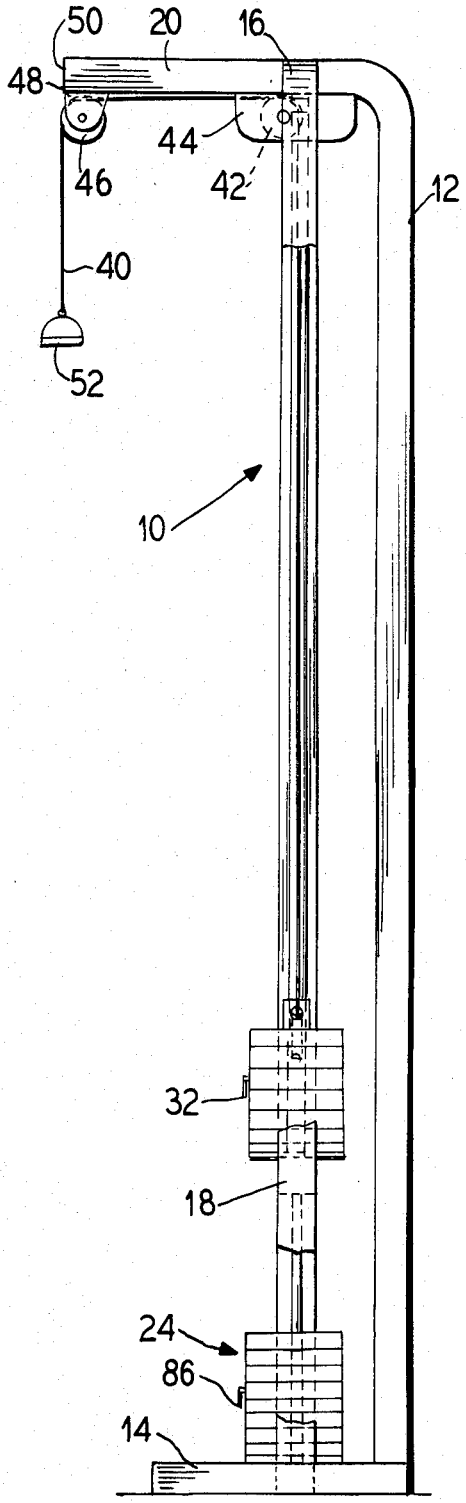
FIG. 2 is a side elevational view of the device shown in FIG. 1.

In FIG. 1 there is shown a body training device generally at 10 which comprises a weight lifting machine having a main vertical frame 12 secured to a base 14 with a top horizontal cross-member 16 and an intermediate horizontal cross-member 18. The frame also includes a horizontal arm 20, detailed in FIG. 2, which projects forwardly from the center of the top cross-member 16.

The body training device 10 includes a first and second resistance means comprising two stacks of weights 22, 24, each stack being comprised of a set of individual weight plates. The first stack of weights 22 includes a base plate 26 which rests on the cross-member 18. Just above the base receiving plate 26 is a rubber cushion 28. Each of the individual plates above the rubber cushion 28 are provided with a horizontal transverse aperture 30 for receiving a removable pin 32 which can be selectively inserted into any one of the apertures 30 to engage a weight post 34 which has a corresponding number of apertures therethrough for receiving the pin 32. In this manner, the user can select the number of weight plates to be lifted.

Figure 3:
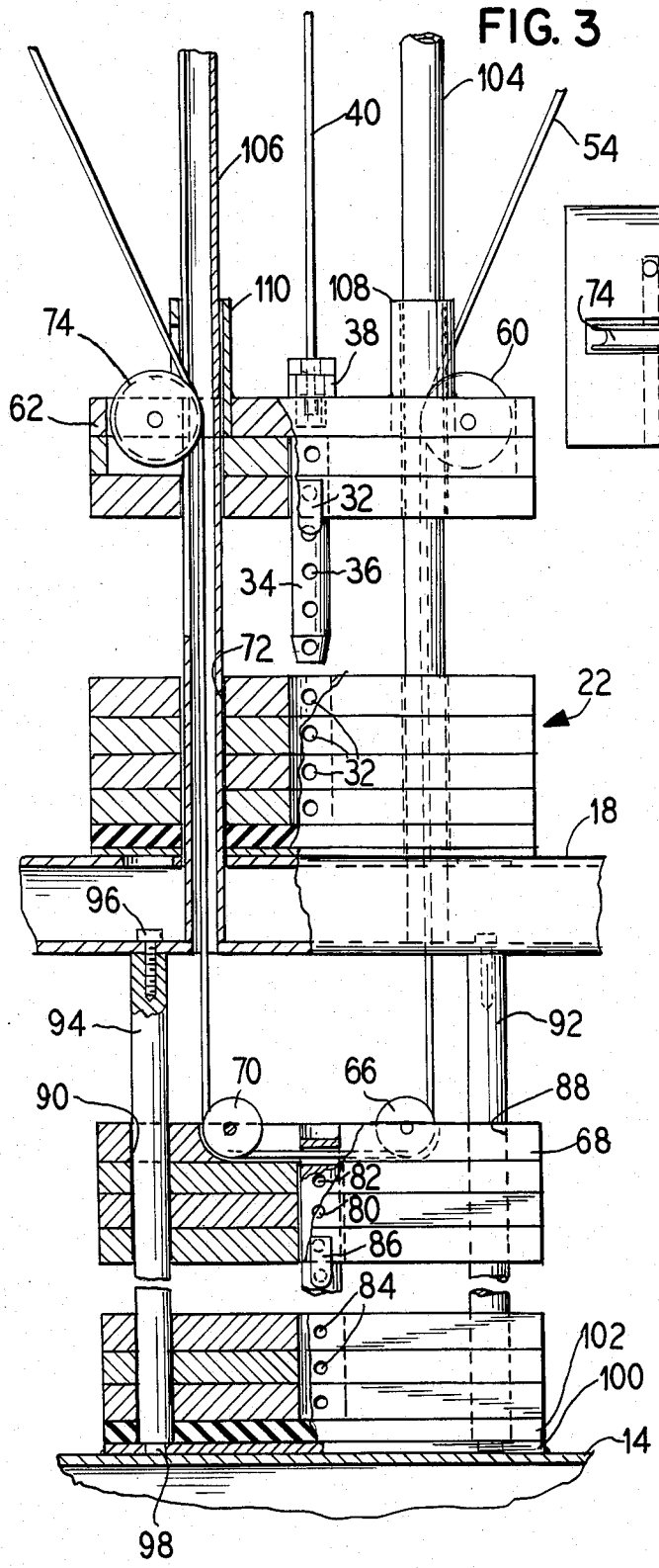
FIG. 3 is an enlarged partial elevational view partially broken away showing the details of the device shown in FIG. 1.
Figure 4:
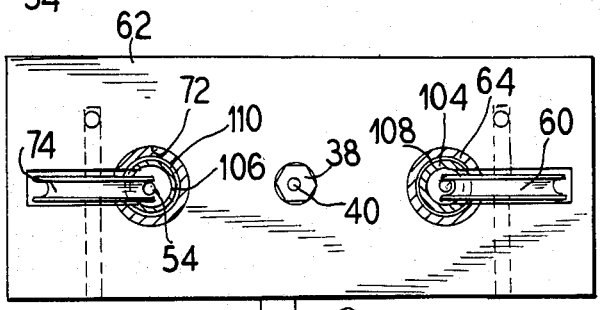
FIG. 4 is a sectional view taken generally along the line IV—IV of FIG. 3.
Figure 5:
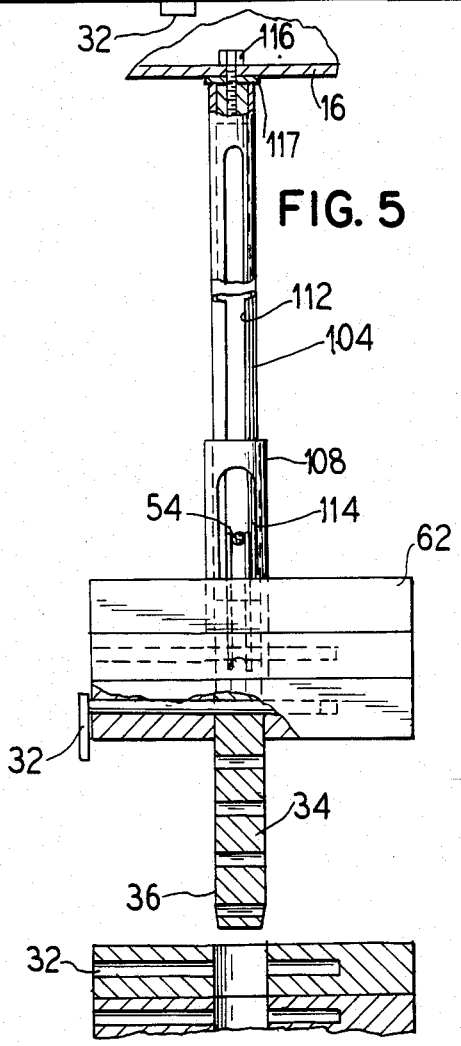
FIG. 5 is a partial side elevational view, partially cut away of the device shown in FIG. 1.

The weight post 34 is connected by means of a threaded plug 38, as best shown in FIG. 3, to a cable 40 which extends upwardly toward the top cross-member 16 and passes over a pulley 42 secured in a set of brackets 44 which are mounted on the cross-member 16. A second pulley 46 is secured to a set of brackets 48 at a front end 50 of the forwardly extending frame member 20. The cable 40 continues over the second pulley 46 and is attached to a handle member 52 which can be grasped by a user.

Thus, when the user pulls downwardly on the handle 52, it causes the weight stack 22 with the selected number of weight plates to be lifted upwardly by the cable 40.

A second cable 54 is secured at a first end 56 to a bracket 58 at an end of the cross-member 16 and passes downwardly over a first pulley 60 mounted in a top plate 62 of the first weight stack 22, through a series of aligned apertures 64 extending through each of the individual plates and continuing down through the intermediate cross-member 18 to pass under a first pulley 66 mounted in a top plate 68 of the bottom stack 24 and under a second pulley 70 also mounted in the top plate 68 to then travel upwardly through a second series of aligned apertures 72 in the intermediate frame 18 and plates of the first stack 22 to pass over a second pulley 74 mounted in the top plate 62 of the first weight stack and up to a turnbuckle 76 which is connected to a bracket 78 at an opposite end of the cross-frame 16 from the first bracket 58.

The top plate 68 of the second stack 24 has a downwardly extending weight post 80 mounted thereto which has a plurality of apertures 82 therethrough which align with apertures 84 in each of the weight plates of the second weight stack 24 for receiving a pin 86 which the user can utilize to select the number of individual plates to be used in the second stack 24.

The second stack also has a pair of aligned apertures 88, 90 extending through each of the individual plates to receive a pair of vertical guide posts 92, 94 which extend from the base 14 to the intermediate cross-bar 18. The vertical guide bars 92, 94 are each secured in place by appropriate fastening means such as bolts 96 at a top end and by a reduced sized bottom end 98 extending into an aperture in the base 14. The bottom stack 24 has a bottom receiving plate 100 and an elastomeric or rubber cushion 102 upon which all of the individual plates of the stack 24 rest.

The top or first weight stack 22 has a pair of guide posts 104, 106 associated therewith which are received in the aligned apertures 64, 72. The guide posts ensure that the weight stack will not twist or tip when being moved. To further ensure that tipping does not occur, the top plate 62 is provided with guide sleeves 108, 110 which project upwardly a short distance above the top of the top plate 62 and which slidingly receive the guide tubes 104, 106.

The guide tubes 104, 106 are hollow to receive the cable 54 which passes therethrough and the tubes also have a slot in the side thereof to allow the cable 54 as well as the pulleys 60, 74 to enter through the side of the tubes. The sleeves 108, 110 also have a slot 114 to permit the cable and the pulleys 60, 74 to pass through the sleeve as well as the tubes. The guide posts 104, 106 are each secured at a bottom end to the intermediate cross-member 18 and at a top end to the top cross-member 16 by appropriate fastening means such as bolts 116.

Since twisting of the guide posts 104, 106 would cause a rubbing between the posts and the pulleys 60, 70 and the cable 54, a locking means 117 such as a lock washer is used in association with each of the bolts 116.

In operation, as the user pulls on the handle 52 thereby lifting the selected weight plates of the top stack 22, the selected plates of the bottom stack 24 produce tension throughout the continuous cable 54. The pulleys 66 and 70, under which the cable 54 passes, enable an equalization of tension throughout the cable 54. A segment 118 of cable 54 which extends between its point of attachment 56 and the first pulley 60 in the top plate 62 of the top stack as well as a cable segment 120 which extends between the point of attachment at turnbuckle 76 and the second pulley 74 on the top plate 62 of the top stack 22 are both rendered semi-rigid by the tension produced through the second weight stack 22 and function like rigid levers.

As the first weight stack 22 is pulled upwardly by the cable 40, the pulleys 60 and 74 fastened to the top plate 62 of the top weight stack 22 cause the cable segments 118 and 120 to be moved to an increasingly more acute angle relative to the top cross-frame 16 as shown in phantom in FIG. 1. This causes a constantly increasing percentage of weight in the second stack 24 to be added to the first stack 22 as the first stack moves upwardly. By selecting a greater or lesser number of weight plates in the second stack 24, a greater or lesser percentage of resistance increase will result over identical distances traveled by the first stack 22.

Thus, resistance curves ranging from fairly constant, with only the top plate 68, to rapidly increasing, by using the entire second stack 24, may be produced by this apparatus. A base level or starting resistance is established by selecting the desired number of plates in the first stack 22.

The turnbuckle 76 is used to take up slack in the cable 54 to compensate for stretching of the cable and to ensure the second stack 24 is immediately lifted from the rubber cushion 100 when the first stack 22 is lifted.

The force of the cable segments 118 and 120 acting on the top stack 22 automatically dampen out vertical inertial forces in the upward movement of stack 22. The dampening is caused by the slow moving bottom stack 24 which does not gain the speed or momentum of the upper stack 22. The degree of dampening is dependent upon the ratio of the weight and speed of the top stack 22 to the weight and speed of the lower stack 24. Thus, the device operates as a low inertia device and termination of upward movement of the stack 22 caused by pulling on the cable 40 will not result in continued upward movement of the first stack 22.

Figure 6:
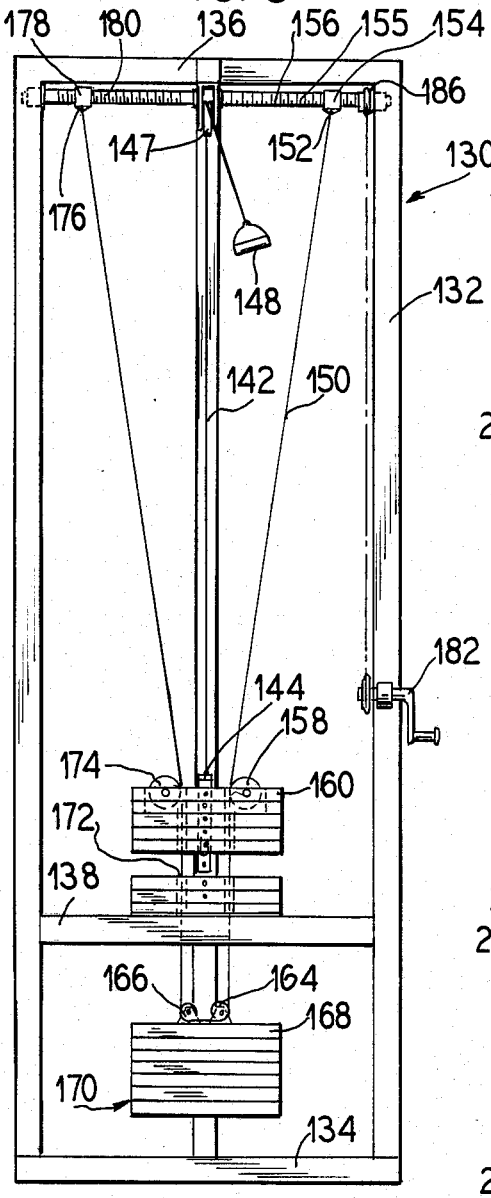
FIG. 6 is a front elevational view of an alternative embodiment of the present invention.

In FIG. 6 there is shown an alternate embodiment of a body training device generally at 130 which includes a pair of vertical frame members 132 which are secured to a bottom base 134, having a top cross-member 136 and an intermediate cross-member 138. A first resistance means being a weight stack 140 rests on intermediate cross-member 138 and connects to a cable 142 through a weight post 144 in a manner similar to that described above. The cable 142 extends up to the top cross-member 136 where it passes over a pair of pulleys 146, 147 (FIG. 8) and is attached to a handle 148 for lifting selected plates of the first stack 140.

Figure 7:
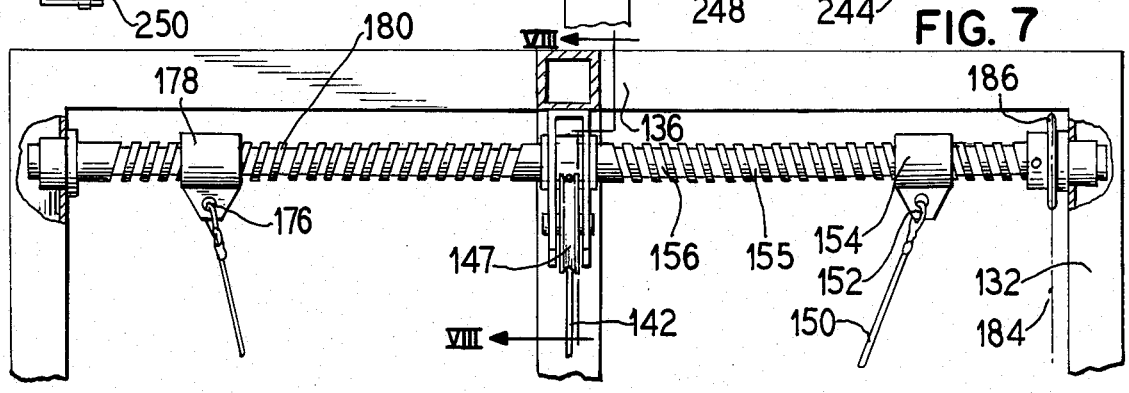
FIG. 7 is an enlarged detailed view of a portion of the device shown in FIG. 6.

A second cable 150 attaches at a first end 152 to a bracket 154 threadingly captured on a threaded portion 155 of a rotatable rod 156 (shown in greater detail in FIG. 7). The cable 150 extends downwardly over a first pulley 158 mounted in a top plate 160 of the first stack 140, through a series of aligned apertures 162 through each of the plates and the intermediate cross-member 138 to pass under a pair of pulleys 164, 166 which are secured to a top plate 168 of a second resistance means also being a weight stack 170. The cable continues up through a second aligned series of apertures 172 over a second pulley 174 mounted on the top plate 160 of the first stack 140 and is secured at a second end 176 to a threaded bracket 178 threadingly received on a reverse threaded portion 180 of the rod 156. The second weight stack 170 has a number of weight plates which are permanently secured together and the stack 170 hangs suspended by the cable 150 at all times.

As shown in FIG. 8, the pulley 146 is spaced below and slightly forward of the rod 156 to position the cable 142 directly below the rod 156 as it extends between the pulley 146 and the weight post 144. This is important to prevent tipping of the weights as they are being lifted.

Similar to the operation described above, as the user pulls on the handle 148, the cable 142 causes the selected number of plates of the top stack 140 to move upwardly. This causes a pinching of the cable 150 and the two cable segments operate as levers to cause an upward movement of the second weight stack 170 while applying a downward force on the top weight stack 140. Thus, as the first weight stack is moved vertically, a varying resistance curve results.

The threaded rod 156 is rotatably carried in the frame members 132 and can be rotated by means of a crank 182 which operates a chain 184 connected to a sprocket 186 on the threaded bar 156. As the bar 156 is rotated, the brackets 154 and 178 are caused to move laterally inwardly or outwardly at the same rate, but in opposite directions to provide a varying angle of the cable segments between the brackets 154, 178 and the pulleys 158 and 174. By varying the selected angle, different resistance curves can be achieved with the same second weight stack 170.

As the brackets 154, 178 are moved laterally together, the effect of movement of the first stack 140 on the second stack 170 is reduced. When the brackets 154, 178 are positioned directly above the aligned apertures 162, 172, movement of the first stack 140 will have no effect on the second stack 170. When the brackets 154, 178 are positioned at opposite lateral sides of the frame, movement of the first stack 140 will have a maximum effect on the second stack 170.

Figure 9:
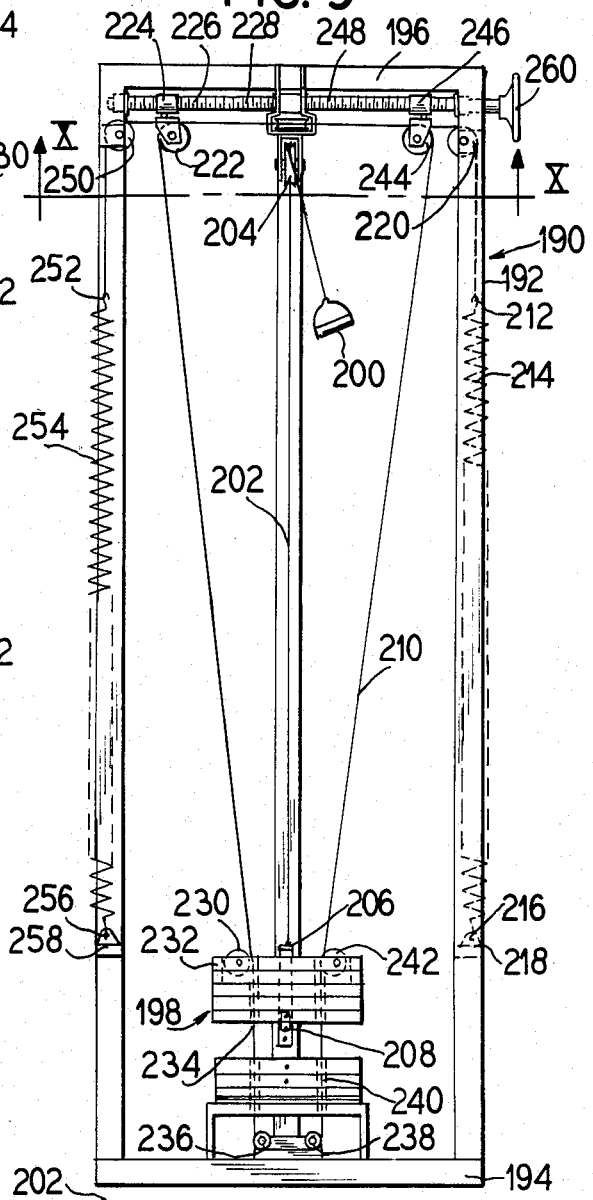
FIG. 9 is a front elevational view of an alternate embodiment of the present invention.

In FIG. 9, there is shown a second alternate embodiment of a body training device 190 embodying the principles of the present invention which, similar to the previous embodiments includes a vertical frame 192 secured to a base 194 and having a horizontal cross-member 196 at a top end. This embodiment utilizes a single weight stack 198 being the first resistance means which is lifted by a handle 200 connected to a cable 202 passing over a pair of pulleys 204 attached to the top horizontal cross-member 196 and extending down to a weight post 206 to which a selected number of weight plates are attached by means a pin 208 as described above.

Figure 10:
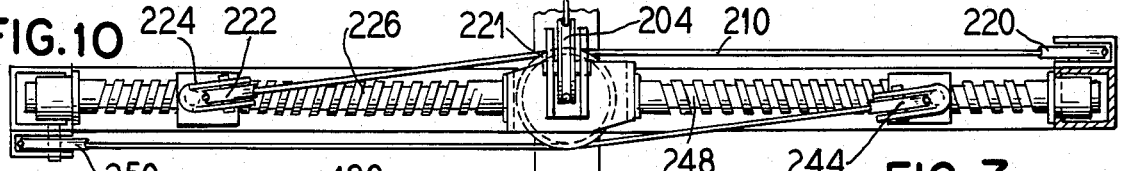
FIG. 10 is a sectional view taken generally along the line X—X of FIG. 9.

A second cable 210 is attached at a first end 212 to a vertically disposed spring 214. The spring 214 is attached at a bottom end 216 to a bracket 218 secured to the vertical frame 192. The vertical frame 192 may be a square tube frame enclosing the spring 214. The cable 210 extends upwardly from its connection point 212 over a first pulley 220 secured near a top end of the vertical frame 192 and continues on around a horizontal pulley 221 to a second pulley 222 pivotally secured to threaded bracket 224 carried on a threaded portion 226 of a rotatable bar 228. This is shown in greater detail in FIG. 10. The cable 210 continues downwardly to pass over a pulley 230 mounted in a top plate 232 on the weight stack 198 and down through an aligned series of apertures 234 to pass under a first 236 and second 238 pulley secured to the base 194. The cable 210 continues upwardly through an aligned series of apertures 240 in the weight plates of the weight stack 198, over a second pulley 242 mounted in the top plate 232 and upwardly to pass over a pulley 244 pivotally mounted to a threaded bracket 246 carried on a reverse threaded portion 248 of the bar 228. The cable 210 continues around the horizontal pulley 221 and passes over a pulley 250 secured to a top end of the frame 192 laterally opposite the pulley 220 and continues down to a termination point 252 where it attaches to a second spring 254 similar to spring 214. The second spring 254 extends downwardly along the frame 192 and is attached at a bottom end 256 to a bracket 258 secured to the frame 192.

In use, the user grasps the handle 200 and pulls downwardly on it causing the selected plates of the weight stack 198 to be lifted upwardly by the cable 202. As this occurs, the pulleys 230, 242 act against cable 210 causing the springs 214 and 254 to be increasingly stretched. This stretching results in an increasing resistance as the weight stack 198 is lifted. The springs 214 and 254 are thus a second resistance means.

The variation of the resistance curves is again achieved by rotating the rod 228. A handle 260 is provided at one end of the rod to facilitate rotation of the rod. Since the two threaded portions 226 and 248 are oppositely threaded, the two pulley carrying brackets 224 and 246 move inwardly and outwardly at an equal rate, but opposite direction.

To reduce the effect of the springs 214, 254, the rod 228 is rotated so that the pulleys 222 and 244 are positioned to be directly above the aligned apertures 234 and 240 so that movement of the selected plates of the weight stack 198 will have no effect on the cable 210. In the view of FIG. 8, this is accomplished when the pulley 222 is moved toward the right, thereby reducing tension on the spring 214 and the pulley 244 is moved to the left thereby reducing tension on the spring 254.

As the pulleys are moved outwardly toward the sides of the frame 192, not only do the pulleys 230, 242 on the weight stack 198 have an increasing effect on cable 210, but also the tension on the springs 214, 254 is continuously increased. Thus, the spring 214, 254 act as resistance producing means in lieu of a second weight stack as described in the previous embodiments.

As the lateral movement of the pulleys 222, 244 occurs, the pulleys 222, 244 pivot with respect to the rod 228, maintaining a centered vertical alignment of the cable 210 with the pulleys 230, 242 as well as directing the cable 210 around the horizontal pulley 221 without any binding.

FIG. 11 is a schematic view of an alternate arrangement of the body training device embodying the principles of the present invention similar to that shown in FIG. 6 which again includes a vertical frame 270 mounted to a horizontal base 272 and having a horizontal top cross-member 274. An intermediate horizontal cross-member 276 is also provided on which a first weight stack 278 rests. A handle 280 is attached to a cable 282 which passes over pulleys 284 and is secured to a weight post 286 to carry a selected number of weight plates of the first weight stack 278 as described above.

A second cable 288 is attached at a first end 290 to the base 272 and passes upwardly through an aperture 292 through a second weight stack 294, up through the intermediate cross-member 276 and an aligned series of apertures 296 in the first weight stack 278, over a pulley 298 secured in a top plate 300 in the first weight stack 278 and up over a pulley 302 secured to a threaded bracket 304 carried on a threaded portion 306 of a rotatable rod 308. The cable 288 continues laterally inwardly toward the center of the upper frame member 274 to a fixed pulley 310 mounted on a bracket 312 near the center of the upper frame member 274 changing the direction of the cable 288 and directing it downwardly through the aligned apertures 296 in the first weight stack 278, through the intermediate cross-member 276 and under a pair of pulleys 314 secured to a top plate 316 in the second weight stack 294. From the pair of pulleys 314, the cable extends upwardly through the intermediate cross-member 276 through an aligned series of apertures 318 in the first weight stack 278 to pass over a second fixed pulley 320 mounted in bracket 322 near the center of the top frame member 274. The cable 288 then continues laterally outwardly and passes around a pulley 324 secured in the vertical frame member 270 and over another pulley 326 secured to a threaded bracket 328 carried on a reverse threaded portion 330 of the rotatable bar 308. The cable then continues downwardly over a second pulley 332 in the top plate 300 of the first weight stack 278, down through the aligned apertures 318 and through the intermediate cross-member 276 and through an aperture 334 in the second weight stack to a second end 336 secured to the base 272.

A crank member 338 is connected to a chain 340 which passes over a sprocket 342 secured to the rotatable bar 308. Rotation of the crank 338 causes rotation of the bar 308 resulting in equal and opposite lateral movement of the pulleys 302 and 326.

When the user pulls on the handle 280, the selected number of weight plates of the first weight stack 278 are lifted by means of the cable 282, and the pulleys 298 and 332 cause the cable 288 to be deflected as described previously thereby resulting in the second weight stack 294 being lifted.

In order to minimize the height required for the frame to accomodate the vertical movement of the second weight stack 170 in the embodiment shown in FIG. 6 due to the lateral movement of the brackets 154 and 178, the embodiment of FIG. 11 employs the take-up pulley 324. Thus, as the rotatable bar 308 is rotated causing the brackets 304 and 328 to move closer together, instead of the second weight stack 294 moving downwardly, the excess length of the cable 288 is taken up through the use of the pulley 324. Therefore, additional height of the frame 270 to accomodate set-up movement of the second weight stack 294 is not required in the embodiment shown in FIG. 11 as it is in the embodiment shown in FIG. 6. This may be particularly useful in areas where there is a height restriction for the frame such as home use. In all other respects, the operation of the device shown in FIG. 11 is the same as that described in previous embodiments.

FIG. 12 is a schematic view of an alternate arrangement of the body training device showing an alternate placement for a second weight stack 350. In this arrangement, the operation of a first weight stack 352 is identical to that described above with a cable 354 and a handle 356 and a pulley 358. The second weight stack 350 is suspended from a cable 360 passing over a pulley 362 mounted in a vertical frame 364 of the device and down over a pulley 364 mounted in the top plate 366 of the first weight stack 352, through the weight stack and under a pulley 368 mounted to a base 370 of the device. The cable then travels upwardly through the first weight stack 352 over a second pulley 372 and is secured near a top end of the frame 360 laterally opposite the pulley 362. As described with respect to the first embodiment shown in FIGS. 1–5, as the handle 356 is pulled, the first weight stack 352 is lifted causing pulleys 364 and 372 to act on the cable 360 resulting in the selected number of weight plates on the second weight stack 350 to be lifted from the rest position. Selection of varying numbers of weight plates from the second weight stack 350 will result in varying resistance curves.

FIG. 13 shows yet another arrangement of the body training device in which a first weight stack 380 is operated similarly to that described above by pulling on a handle 382 attached to a cable 384 passing over a set of pulleys 386. A guide post 388 is provided for vertical stability of the weight plates being lifted off of the first weight stack 380. A second weight stack 390 has a direct attachment to a cable 392 at a top weight plate 394. The cable 392 passes upwardly through the first weight stack 380, over a pulley 396 and is secured at an upper end to a threaded bracket 398 carried on a rotatable threaded rod 400. As similarly described above, the bracket 398 can be moved laterally by rotating the bar 400. Again, as the handle 382 is pulled thus lifting the selected weight plates of the first weight stack 380, the pulley 396 acts on the cable 392 to lift the second weight stack 390. By adjusting the location of the bracket 398 the resistance curves can be altered.

Thus, it is seen that the present invention provides a body training device in which many different muscle groups may be exercised by easily changing the resistance curves to accomodate the different muscle groups. Also, it is seen that the present invention provides for a low inertia device in which the second resistance means, being the second weight stack or springs continuously acts against the first resistance means or first weight stack to prevent continued movement of the first resistance means after the user has stopped pulling on the handle.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A body training device, comprising:
(a) a frame including a horizontal base member, an upper support member, and a horizontal intermediate support member;
(b) a weight stack comprised of individual weight plates supported at rest on said horizontal intermediate support member;
(c) a first cable having a handle at one end and connected at the other end to a selectable number of said weight plates, and passing over a first pulley means secured to said upper support member;
(d) a second pulley means rotatably supported on the uppermost one of said weight plates;
(e) a third pulley means disposed functionally directly below said second pulley means;
(f) a second cable extending about said third pulley means and thence vertically upwardly through said weight stack and against said second pulley means on said weight stack and thence upwardly in two angularly diverging portions to said upper support member of said frame; and
(g) means tensioning said second cable.

2. A device of claim 1 wherein said tensioning means means comprises a further stack.

3. A device of claim 1 wherein said tensioning means means comprises spring means.

4. A device of claim 1 wherein said second cable means engages said pulley means at a varying angle as said weight stack is moved.

5. A device of claim 4 wherein an initial angle of engagement of said second cable means and said second pulley means is selectively variable.

6. A device of claim 4 wherein the initial resistance of said tensioning means is selectively variable.

7. A body training device comprising:
(a) a frame having vertical support members extending upwardly from a base member and interconnected at a top end by a horizontal support member and interconnected intermediate the top and bottom by a horizontal support member;
(b) a first weight stack comprised of individual weight plates supported on said intermediate support member;
(c) first cable and handle means connectable to a selectable number of weight plates in said weight stack;
(d) first pulley means mounted on said frame for engaging said cable means to change direction of said cable means to permit lifting of said selected weight plates of said weight stack by manual exertion of a force on said handle means;
(e) a second weight stack comprised of individual weight plates supported on said frame base in alignment, below said first weight stack;
(f) second cable means secured at a first end near the top of said frame at one lateral side thereof and at a second end near the top of said frame at an opposite lateral side;
(g) at least one passage vertically through said first weight stack and second pulley means mounted adjacent a top end of said passage on said weight stack to direct said second cable means through said passage;
(h) third pulley means mounted on a top end of said second weight stack to reverse the direction of said second cable means;

whereby, as said handle means is moved by a user, the selected portion of said first weight stack is lifted causing said second pulley means to act against said second cable means resulting in an upward movement of said second weight stack, the movement of said second weight stack increasing in proportion to the movment of said first weight stack as the lifted height of said first weight stack increases.

8. A body training device comprising:
(a) a frame having vertical support members extending upwardly from a base member and interconnected at a top end by a horizontal support member and interconnected intermediate the top end and said base member by a horizontal support member;
(b) a weight stack comprised of individual weight plates supported on said intermediate support member;
(c) first cable and handle means connectable to a selectable number of weight plates in said weight stack;
(d) first pulley means mounted on said frame for engaging said cable means to change direction of said first cable means to permit lifting of said selected weight plates of said weight stack by manual exertion of a force on said handle means;
(e) a selectively rotatable bar carried in said vertical frame near a top end thereof, and having oppositely threaded halves;
(f) a pair of internally threaded brackets, each carried on one of said threaded halves of said bar;
(g) a fourth pulley means carried on each of said threaded brackets;
(h) a pair of extendable spring means, each secured to vertical support members of said frame at a first end;
(i) second cable means secured at a first end to a second end of one of said spring means, and at a second end to a second end of the second of said spring means, said second cable means passing over said fourth pulley means;
(j) at least one passage extending vertically through said first weight stack, and second pulley means mounted adjacent to a top end of said passage on said weight stack to direct said second cable means through said passage;
(k) third pulley means mounted on said base below said passage to reverse the direction of said second cable means;

whereby, as said handle means is moved by a user, the selected portion of said weight stack is lifted causing said second pulley means to act against said second cable means resulting in extension of said spring means, the extension of said spring means increasing in proportion to the movement of said weight stack as lifted height of said weight stack increases, and as said bar is rotated, the angle of said second cable means engaging said second pulley means changes, thereby changing the degree of effect of movement of said weight stack on said spring means.

9. A body training device comprising:
(a) a frame having vertical support members extending upwardly from a base member and interconnected at a top end by a horizontal support member and interconnected intermediate the top and bottom by a horizontal support member;
(b) a first weight stack comprised of individual weight plates supported on said intermediate support member;

(c) first cable and handle means connectable to a selectable number of weight plates in said weight stack;

(d) first pulley means mounted on said frame for engaging said cable means to change direction of said cable means to permit lifting of said selected weight plates of said weight stack by manual exertion of a force on said handle means;

(e) a selectively rotatable bar carried in said vertical frame near a top end thereof and having oppositely threaded halves;

(f) a pair of internally threaded brackets, each carried on one of said threaded halves of said bar;

(g) second cable means secured at its ends to said brackets, respectively;

(h) said first weight stack having at least one passage extending vertically therethrough;

(i) second pulley means mounted adjacent to a top end of said passage on said first weight stack;

(j) a second weight stack;

(k) third pulley means mounted on a top end of said second weight stack;

(l) said second cable means extending from said brackets, against said second pulley means, through said passage in said first weight stack, and around said third pulley means on said second weight stack;

whereby, as said handle means is moved by a user, a selected portion of said first weight stack is lifted causing said second pulley means to act against said second cable measn resulting in an upward movement of said second weight stack, the movement of said second weight stack increasing in proportion to the movement of said first weight stack as the lifted height of said first weight stack increases, and as said bar is rotated, the angle of said cable means engaging said second pulley means changes, thereby changing the degree of effect of movement of said first stack on said second stack.

* * * * *